US006190239B1

(12) United States Patent
Buzzetti

(10) Patent No.: US 6,190,239 B1
(45) Date of Patent: Feb. 20, 2001

(54) POLISHING METHOD USING TWO STAGE MEMBERS

(76) Inventor: Mike Buzzetti, 4401 "D" El Camino Real, Atascadero, CA (US) 93422

( * ) Notice: Under 35 U.S.C. 154(b), the term of this patent shall be extended for 0 days.

(21) Appl. No.: 09/390,383

(22) Filed: Sep. 3, 1999

Related U.S. Application Data

(62) Division of application No. 08/922,070, filed on Sep. 2, 1997, now Pat. No. 5,947,797.
(60) Provisional application No. 60/025,906, filed on Sep. 11, 1996.

(51) Int. Cl.[7] ..... B24B 1/00
(52) U.S. Cl. ..... 451/42; 451/160
(58) Field of Search ..... 451/5, 11, 28, 451/41, 42, 158, 159, 160, 162, 163, 164, 166, 278, 384, 389

(56) References Cited

U.S. PATENT DOCUMENTS

| | | | | |
|---|---|---|---|---|
| 3,435,562 | * | 4/1969 | Maillet | 451/166 X |
| 4,693,035 | | 9/1987 | Doyle . | |
| 4,850,152 | * | 7/1989 | Heynacher et al. | 451/166 X |
| 4,891,916 | * | 1/1990 | Rhoades et al. | 451/166 X |
| 4,979,334 | | 12/1990 | Takahaski . | |
| 5,107,627 | | 4/1992 | Mock, Jr. et al. . | |
| 5,184,433 | * | 2/1993 | Maack | 451/166 X |
| 5,201,148 | | 4/1993 | Rupert et al. . | |
| 5,216,846 | | 6/1993 | Takahaski . | |
| 5,349,784 | | 9/1994 | Grois et al. . | |
| 5,458,531 | | 10/1995 | Matsuoka et al. . | |
| 5,516,328 | | 5/1996 | Kawada . | |
| 5,674,114 | | 10/1997 | Miller et al. . | |
| 5,743,787 | | 4/1998 | Ishiyama et al. . | |
| 5,895,311 | * | 4/1999 | Shiotani et al. | 451/166 X |

* cited by examiner

*Primary Examiner*—Timothy V. Eley
(74) *Attorney, Agent, or Firm*—Leo F. Costello

(57) ABSTRACT

A method for creating and maintaining a substantially perfect figure eight polishing pattern for polishing fiber optic connectors and similarly configured industrial components. The method is capable of simultaneously performing this figure eight polishing pattern on the multiplicity of such connectors and components. Moreover, the specific embodiment disclosed includes a computer program that controls the method. By simultaneously polishing a minimum of forty-eight fiber optic connectors, or similarly configured industrial components, with a polish being better than any now capable of being obtained by the prior art, this invention enables the output of polished fiber optic connectors and similarly configured industrial components to be increased three to four fold over currently employed polishing method while significantly reducing the cost of such polishing.

23 Claims, 2 Drawing Sheets

POLISHING METHOD USING TWO STAGE MEMBERS

CROSS REFERENCE TO RELATED APPLICATION

This application is a division of my prior application No. 08/922,070, filed Sep. 2, 1997, and now U.S. Pat. No. 5,947,797 and entitled Computer-Controlled Method and Apparatus for Polishing (Amended) which in turn was based upon my Provisional Application No. 60/025,906, filed on Sep. 11, 1996.

FIELD

The present invention pertains to a polishing method and more particularly to a method for controlling the movement of a polishing member along a predetermined path.

BACKGROUND

Fiber optic connectors are required in large quantities in the telecommunications and cable TV markets for the manufacture of fiber optic cable assemblies and components. Current fiber optic connector polishers (a) polish only in a circular pattern which does not polish the face ends of fiber optic connectors as effectively as does a figure eight polishing, and (b) these current polishers can polish no more than eighteen connectors at one time.

The existing state of the art for fiber optic connector polishers is derived from modifications of gemstone polishing machines. These machines consisted of a rotating platter against which the gemstone was moved for polishing. This technique was adopted by the first fiber optic connector polishers, and then modified to their current state, by having a jig, holding no more than eighteen connectors, move, in small circles on the rotating platter, while endeavoring, unsuccessfully, to simulate a constant, figure eight polishing pattern. The figure eight polishing pattern, if it can be perfectly attained and maintained during the polishing operation, provides the optimum method of polishing the end faces of fiber optic connectors in that perfect figure eight pattern produces the most consistent radii and best polish obtainable on these connectors and similarly configured industrial components.

SUMMARY

A polishing method is provided for creating and maintaining a substantially perfect figure eight polishing pattern for polishing fiber optic connectors and similarly configured industrial components. Further, the method is capable of simultaneously performing this figure eight polishing pattern on a multiplicity of such connectors and components. Moreover, the specific embodiment disclosed includes a computer program that controls the method. By simultaneously polishing a minimum of forty-eight fiber optic connectors, or similarly configured industrial components—with the polish being better than any now capable of being obtained in the prior art —this invention will enable the output of polished fiber optic connectors and similar industrial components to be increased three to fourfold over currently employed polishing machines, while reducing significantly the cost of such polishing.

An object of this invention is to provide a method for creating and maintaining a figure eight polishing pattern for polishing fiber optic connectors and similarly configured industrial components.

Another object is to provide such a method that is capable of polishing in a substantially perfect figure eight pattern.

A further object is to provide a method for creating a substantially uniformly constant, that is substantially perfect, figure eight polishing pattern which will produce the optimum quality polishing of a multiplicity of fiber optic connectors or similarly configured industrial components.

An additional object is to provide a method for creating a substantially perfect figure eight polishing pattern that is computer controlled.

A still further object is to incorporate a figure eight polishing method into a compact polishing machine capable of creating and constantly maintaining a substantially perfect figure eight polishing pattern while simultaneously polishing, with optimum quality, at least forty-eight fiber optic connectors or similarly configured industrial components.

Yet another object is to provide such a polishing method that has a layout which enables more than forty-eight such connectors or components to be subsequently added for simultaneous figure eight polishing.

DETAILED DESCRIPTION

Figure 1:
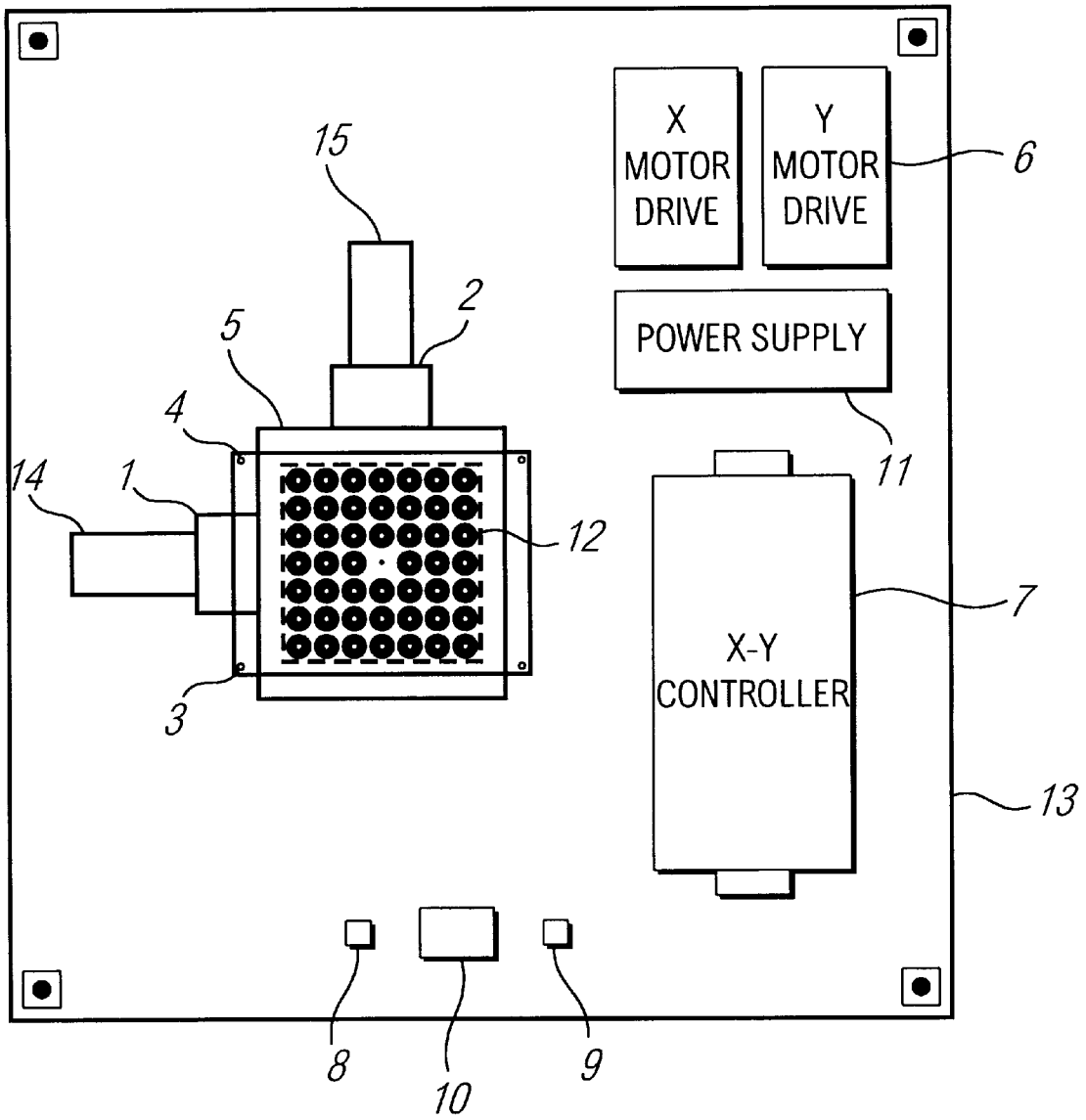
FIG. 1 is a schematic top view of a polishing apparatus capable of performing the polishing method of the present invention.
Figure 2:
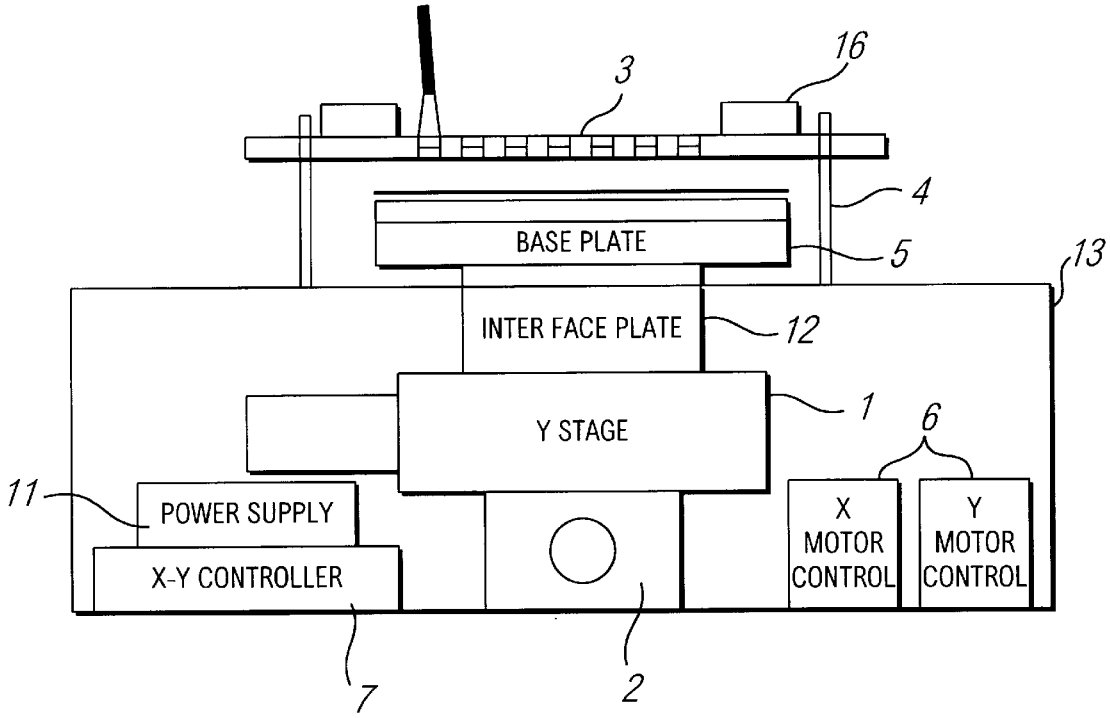
FIG. 2 is a schematic side elevation of the polishing apparatus and also shows a jig for mounting a component to be polished, as used to carry out the subject method.
Figure 3:
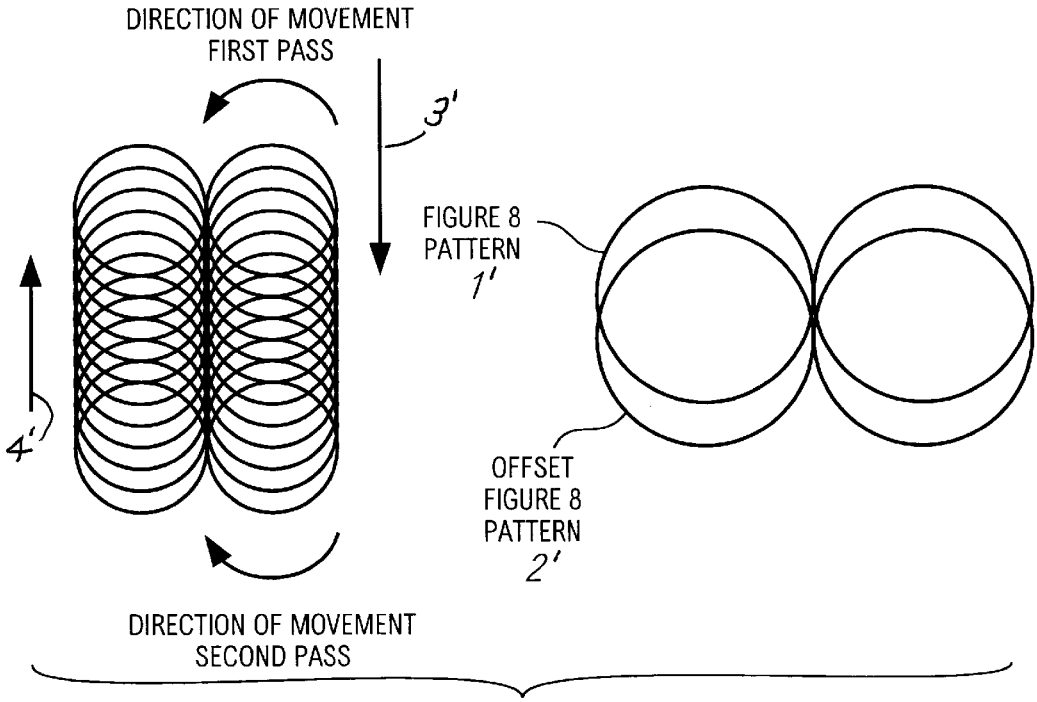
FIG. 3 are a schematic diagrams showing the path and direction of movement of the base plate as controlled by the subject polishing method.

As illustrated by FIGS. 1 and 2, the layout of the polishing apparatus capable of performing the polishing method allows the use of all the space on the polishing surface. By using a rectangular array the connectors are spaced at one inch intervals and create an array which can be expanded to as many as two hundred connectors to be polished simultaneously. Polishing machines now in use do not allow for this type of expansion in that they can only place the connectors in the outermost edges of the polishing plate. As illustrated by FIG. 3, the polishing apparatus can accurately produce a constant and perfect figure eight polishing pattern and move this pattern in any direction by using the invention's computer controlled x-y motion control process with circular interpolation.

The polisher (FIGS. 1 and 2) includes a casing 13. Installed within the casing is an x-stage 1, a y-stage 2, an interface plate 12, a base plate 5, motor drives 6, a power supply 11, an x-y controller 7, an x-motor 15, and a y-motor 14. The mechanical components for the motion system comprise the x-stage 2 mounted to the casing 13, the y-stage 1 mounted to the x-stage 2, the interface plate 12 mounted to the y-stage 1, and the base plate 5 mounted to the interface plate 12.

The x-stage 2 and the y-stage 1 are moved via the motors 15 and 14, respectively, attached to these stages. The y-motor 14 attached to the y-stage 1 moves this stage in the y-axis by a ball screw mechanism built into the stage. The x-motor 15 attached to the x-stage 2 moves the x-stage 2 in the x-axis. The y-stage 1 and the x-stage 2 are controlled by an x-y controller 7 and motor drives 6 which are powered by a power supply 11. The controller 7 is a computer-controlled motion system which can be programmed for all types of movement.

The interface plate 12 (FIGS. 1 and 2) is attached to the y-stage 1 as a receiving mechanism for the base plate 5 to which is attached the polishing surface for operation of the polisher apparatus. Different polishing surfaces can be attached to the base plate 5 for the polishing process. These surfaces include such polishing mediums as diamond, aluminum oxide, and silicon carbide polishing papers and other coated plates and pads. The polishing plate 3 is set on the fixed locating members 4 so that the exposed surface of the component to be polished is touching the polishing surface which is applied to the base plate 5. Weights 16 are then applied to the top surface of the polishing plate 3 to supply the correct amount of pressure to the component to be polished. The pressure may also be applied via a pneumatic pressure control system.

The method (FIGS. 1 and 2) is controlled by a timer 10, a start switch 9 and a stop switch 8. The amount of time to polish is set on the timer. The process is started by pressing the start switch 9. The polishing process can be stopped at any time by pressing the stop switch 8.

In the disclosed embodiment the figure eight pattern 1' (FIG. 3) is created by computer programming the x-y motion process to move in a clockwise circle starting from the center of the figure eight, then moving in a counter clockwise circle to finish the figure eight pattern. The offset figure eight pattern 2' is created by moving the figure eight pattern 1' down in one direction 3' a small amount (approximately 0.50 inch). This pattern is repeated several times to a specified distance. Upon completion of this movement, the figure eight pattern 1' is reversed. It then moves in the opposite direction 4' and continues until it reaches a specified distance. The whole process is repeated as many times as needed to perform the desired amount of time set by the timer (see 10, FIG. 1). By combining these patterns the process creates a continuous figure eight movement which enables the polishing surface of the polishing method to provide the optimum quality polishing, simultaneously, of not less than forty-eight fiber optic connectors or similarly configured industrial components.

The computer program for the figure eight pattern is as follows:

```
DEL R: required to overwrite existing program R
DEF R
PSCLD 15
PSCLA2
PSCLAV2
PAD1.3000
PA1.5000
COMEXL.11
DRFLVL11
L30
PARCOP0,0,-6000,0
PARCOMO,0,6000,0
PLINO,-400
LN
pad0.6
PARCOP0,0,-6000,0
PARCOM0,06000,0
END
DEL F: required to overwrite existing program F
DEF F
PSCLD15
PSCLA2
PAD1.3000
PAI.5000
PVI.5000
DRFLVL11
COMEXL11
L30
PARCOP0,06000,0
PARCOMO,0-6000,0
PLIN0,400
LN
pad0.6
PARCOP0,6000,0
PARCOM0,0,-6000, 0
END
DEL Q: required to overwrite existing program Q
DEF Q
ZERO
PRUNF
PRUNR
prunf
prunr
prunf
prunr
END
DEL ZERO: required to overwrite existing program ZERO
DEF ZERO
comex11,1
A1.0000,1.0000
V1.0000,1.0000
AD.3000,.3000
D50000,50000
GO
D-15000,-26000
GO
END
del setup
def setup
comexs2
COMEXL11
DRFLVL11
INFEN1
INLVL11111111111111111111111111111111111
INFNC1-D
INFNC2-4p
INFNC3-p
INSELP2,50
startp setup
end
DEL START: required to overwrite existing program
  START
DEF START
Q
END
PCOMP R
PCOMP F
PCOMP START
PCOMP SETUP
```

Although a preferred embodiment of the present invention has been shown and described, various modifications and substitutions may be made thereto without departing from the spirit and scope of the present invention. Accordingly, it is to be understood that the present invention has been described by way of illustration and not limitation

What is claimed is:

1. A method of polishing a workpiece with a polishing member that is mounted on one of a pair of stage members that are interconnected for movement relative to each other, comprising the steps of:

applying force to a first of the stage members causing it to move translationally along a first path, and applying force to the other second stage member causing it to move translationally along a second path that is angularly related to the first path thereby causing the polishing member to trace a predetermined pattern.

2. The method of claim 1, wherein the paths of movement of the first and second stage member are rectilinear.

3. The method of claim 1, wherein the first path is an x-axis, and wherein the second path is a y-axis substantially perpendicular to the x-axis.

4. The method of claim 1, wherein the speed of movement of said one stage member is a multiple of the speed of movement of the other stage member.

5. The method of claim 4, wherein the multiple is 2.

6. The method of claim 1, wherein the pattern is a figure eight.

7. The method of claim 1, wherein the first stage member is mounted for movement along a third path, including the additional step of applying force to the first stage to move it along the third path.

8. The method of claim 1, wherein the movement along said paths is reciprocal.

9. The method of claim 1, wherein the force is applied to the first and other stage members by motors.

10. The method of claim 1, wherein the force applied to the first and second stage members is computer controlled.

11. A method of polishing a fiber optic connector with a polishing member that is mounted on an x-stage that in turn is mounted on a y-stage, the stages being interconnected for movement relative to each other, comprising the steps of:

reciprocating the x-stage along an x-axis having a predetermined length, and reciprocating the y-stage along a y-axis that is perpendicular to the x-axis and less than the length thereof and at a speed of movement that is greater than the speed of movement of the y-stage whereby the polishing member polishes the connector in a figure eight pattern.

12. The method of claim 11, wherein the both of the stages are reciprocated along a second x-axis parallel to the first mentioned x-axis whereby the figure eight pattern is moved back and forth over the connector.

13. The method of claim 12, wherein the reciprocating movement along each of said axes is controlled by a computer.

14. The method of claim 13 wherein there are control motors connected to the x and y stages and x and y drives connected to the x and y motors respectively, including the further step of:

causing the computer to control the x and y drives and thus the control motors.

15. A method of polishing a workpiece with a polishing member that is mounted on one of a pair of stage members that are interconnected for movement relative to each other, comprising the steps of:

applying force to a first of the stage members causing it to move along a rectilinear first path, and applying force to the other stage member causing it to move along a rectilinear second path that is angularly related to the first path and at a speed of movement that is a multiple of the speed of movement of the first stage member whereby the polishing member is caused to trace a predetermined pattern.

16. A method of polishing a workpiece with a polishing member that is mounted on one of a pair of stage members that are interconnected for movement relative to each other, comprising the steps of:

applying force to a first of the stage members causing it to move along a first path, and applying force to the other stage member causing it to move along a second path that is angularly related to the first path and at a speed of movement that is a multiple of the speed of movement of the first stage member whereby the polishing member is caused to trace a predetermined pattern wherein the first path is an x-axis, and wherein the second path is a y-axis substantially perpendicular to the x-axis.

17. A method of polishing a workpiece with a polishing member that is mounted on one of a pair of stage members that are interconnected for movement relative to each other, comprising the steps of:

applying force to a first of the stage members causing it to move along a first path, and applying force to the other stage member causing it to move along a second path that is angularly related to the first path and at a speed of movement that is a multiple of the speed of movement of the first stage member thereby causing the polishing member to trace a figure eight pattern.

18. A method of polishing a workpiece with a polishing member that is mounted on one of a pair of stage members that are interconnected for movement relative to each other, comprising the steps of:

applying force to a first of the stage members causing it to reciprocally move along a first path, and applying force to the other stage member causing it to reciprocally move along a second path that is angularly related to the first path and at a speed of movement that is a multiple of the speed of movement of the first stage member whereby the polishing member is caused to trace a predetermined pattern.

19. A method of polishing a fiber optic connector with a polishing member that is mounted on an x-stage that in turn is mounted for movement on a y-stage, comprising the steps of:

reciprocating the x-stage along an x-axis having a predetermined length, and reciprocating the y-stage along a y-axis that is perpendicular to the x-axis and less than the length thereof and at a speed of movement that is greater than the speed of movement of the y-stage.

20. The method of claim 19 including the further step of:

reciprocating both of the stages along a second x-axis parallel to the first mentioned x-axis.

21. A method of polishing a workpiece, comprising the steps of:

mounting the workpiece and the polishing member in face-to-face contact so that they can move relative to each other while remaining in such contact; and polishing the workpiece with the polishing member in a figure eight pattern by moving one of the workpiece and the polishing member in a figure eight pattern relatively to the other of the workpiece and the polishing member.

22. The method of claim 21 including the further step of:

moving said one of the workpiece and the polishing member that is moving in said figure eight pattern in a path angularly related to the figure eight pattern thereby causing translation of the figure eight pattern relative to the workpiece.

23. A method of polishing a workpiece with a polishing member that is mounted on first and second stage members that are interconnected for movement relative to each other, comprising the steps of:

translating both of the stage members along a first path, translating the second stage member along a second path that is angularly related to and crosswise of the first path and during translation of both of the stage members along the first path, and causing the speed of movement along one of said paths to be a multiple of the speed of movement along the other path, thereby causing the polishing member to trace a predetermined pattern.

* * * * *